US006051940A

United States Patent [19]

Arun

[11] Patent Number: 6,051,940

[45] Date of Patent: Apr. 18, 2000

[54] SAFETY CONTROL CIRCUIT FOR DETECTING THE REMOVAL OF LAMPS FROM A BALLAST AND REDUCING THE THROUGH-LAMP LEAKAGE CURRENTS

[75] Inventor: Ganesh Arun, Huntsville, Ala.

[73] Assignee: MagneTek, Inc., Nashville, Tenn.

[21] Appl. No.: 09/070,885

[22] Filed: Apr. 30, 1998

[51] Int. Cl.[7] ..... G05F 1/00

[52] U.S. Cl. ..... 315/307; 315/291; 315/224; 315/119; 315/DIG. 4; 315/DIG. 7

[58] Field of Search ..... 315/127, 119, 315/291, 307, 224, 225, 244, 247, DIG. 4, DIG. 7; 363/132

[56] References Cited

U.S. PATENT DOCUMENTS

| | | | |
|---|---|---|---|
| 4,207,497 | 6/1980 | Capewell et al. | 315/96 |
| 4,461,980 | 7/1984 | Nilssen | 315/225 |
| 4,983,887 | 1/1991 | Nilssen | 315/224 |
| 5,111,380 | 5/1992 | Nilssen | 363/132 |
| 5,583,402 | 12/1996 | Moisin et al. | 315/307 |
| 5,642,019 | 6/1997 | Sun | 315/244 |
| 5,650,694 | 7/1997 | Jayaraman et al. | 315/225 |
| 5,650,925 | 7/1997 | Hesterman | 363/132 |
| 5,742,134 | 4/1998 | Wacyk et al. | 315/307 |
| 5,850,127 | 12/1998 | Zhu et al. | 315/307 |
| 5,866,993 | 2/1999 | Moisin | 315/307 |

*Primary Examiner*—Haissa Phuogene
*Attorney, Agent, or Firm*—Waddey & Patterson; Mark J. Patterson

[57] ABSTRACT

A series resonant ballast safety control circuit for controlling the operation of a ballast when a lamp is removed from a lamp fixture. The safety control circuit senses a diode clamp current and activates a transistor to ground one of the terminals of a dimming control circuit. The dimming control circuit reduces the duty cycle of one of the inverter transistors to decrease the available output voltage and reduce the through-lamp leakage current to safe levels. Once the lamp is replaced in the lamp fixture, the safety control circuit no longer controls the dimming control circuit and the ballast returns to normal operation. In another embodiment, the safety control circuit is used with a boost power factor correction circuit in a non-dimming ballast system to reduce the current provided to the lamp load. The safety control circuit is connected to the boost power factor correction circuit so that when the safety control circuit senses a diode clamp current, the safety control circuit disables the boost power factor correction circuit. This prevents the boosted voltage from being supplied to the inverter, which in turn reduces the output voltage provided to the removed lamp and results in a reduced through-lamp leakage current.

15 Claims, 4 Drawing Sheets

SAFETY CONTROL CIRCUIT FOR DETECTING THE REMOVAL OF LAMPS FROM A BALLAST AND REDUCING THE THROUGH-LAMP LEAKAGE CURRENTS

BACKGROUND OF THE INVENTION

The present invention relates to a protection circuit used in an electronic ballast to reduce through-lamp leakage currents. More particularly, the present invention relates to a safety control circuit used in a series resonant ballast driving multiple lamps to reduce the magnitude of through-lamp leakage currents whenever one or more lamps are removed from at least one of the lamp terminals of the lamp fixture.

Those skilled in the design and operation of electronic ballasts have long recognized the problems created by the flow of high magnitude through-lamp leakage currents when lamps driven by such ballasts are removed from the lamp fixture by a service person. A shock hazard situation develops when such a service person is in contact with the earth ground while holding onto one end of a lamp while the other end is still in the lamp terminal. In such a case, a high magnitude of current can flow to ground through the lamp and the person, causing the holder to suffer an electric shock.

Several solutions for providing a safe lamp ballast system for addressing problems similar to the one stated above have been proposed or used in the prior art, with limited success. For example, in U.S. Pat. No. 4,983,887, issued to Nilssen, a circuit is designed to limit the magnitude of high frequency through-lamp leakage current distributed to an open lamp outlet. This is done by providing a negative feedback control circuit which reduces the forward conduction duty cycle of both of the transistors of the inverter of the ballast whenever the peak through-lamp leakage current magnitude exceeds a predetermined level. While this circuit does reduce the magnitude of the high frequency through-lamp leakage current, it requires that the duty cycle of both the transistors be reduced at the same time and further requires a fore-knowledge of the magnitude of current that is allowable. This means that additional sensing and control circuits are required which makes the total circuit more complex and drives up the cost of the ballast.

Others have attempted to reduce the magnitude of these through-lamp leakage currents through shut-down circuits. Shut-down circuits suspend operation of the inverter when a lamp is removed from the lamp fixture that is electrically connected to the ballast. For example, U.S. Pat. No. 4,461,980, issued to Nilssen, describes a protection circuit that disables the ballast inverter approximately one second after a fluorescent lamp is removed from at least one of the lamp terminals of the lamp fixture. This method uses a clamping current to generate heat and actuate a bimetallic switch which causes a short-circuit in the feedback loop of the control circuit, forcing the inverter oscillations to stop. However, this method only addresses a single lamp instant start ballast and requires precise adjustment of the response time of the feedback loop to function properly. Moreover, it requires additional circuitry to reinitiate inverter oscillations, once every 30 seconds after the inverter has been disabled. Shut-down circuits in rapid-start ballasts driving one or two lamps have also been proposed and described. These require additional delay circuits to get past the pre-heat stage during lamp starting. Also, if the delay is not accurate, false triggering can occur, resulting in premature shut-down of the lamps.

Still others have attempted to solve the problem of dangerous through-lamp leakage currents by warning persons of the situation through pulsing circuits installed in the ballasts. These circuits control the inverter transistors of the ballast and force the lamps to flash whenever one of the lamps is removed from a lamp terminal of the lamp fixture. The control circuits that have been used to achieve this are quite sophisticated, however, and add significantly to the cost of producing such a design.

What is needed then, and not found in prior art, is an efficient, simple and inexpensive way of detecting and reducing hazardous through-lamp leakage currents to safe levels whenever one or more lamps are removed from their lamp terminals of the lamp fixture, especially in the case of a ballast driving multiple lamps.

SUMMARY OF THE INVENTION

An object of this invention is to sense and reduce through-lamp leakage currents and thus prevent a shock hazard in a series resonant ballast driving multiple lamps whenever one or more lamps are removed from their lamp terminals. This is accomplished by using a safety control circuit which can work in conjunction with the symmetry control circuit described in U.S. Pat. No. 5,583,402, issued to MagneTek, Inc., incorporated herein by reference.

Another object of this invention is to apply the above safety control circuit to a standard series resonant ballast (which does not have a symmetry control circuit) to reduce the magnitude of through-lamp leakage currents to safe levels to prevent shock hazards.

In the preferred embodiment, the safety control circuit is used in a series resonant ballast that includes a DC power supply, an inverter, a dimming control circuit, and an output transformer that is connected to a lamp load, which includes multiple lamps in series. The DC power supply comes from a boost power factor converter that is connected to a 60 Hz AC line. The inverter is a standard series resonant half-bridge type with an L-C-C tank circuit which is connected to the lamp load through an output transformer. The dimming control circuit changes the amount of current flowing through the lamps by changing the duty cycle of the inverter transistors in response to a low-voltage dimming level signal (0V-to-10V) indicative of the desired amount of current through the lamp load.

By default, with no dimming voltage signal applied, both of the inverter transistors operate at nearly 50% duty cycle each. A zero volt dimming signal results in minimum duty cycle for one of the inverter transistors with a minimum lamp load current (dim mode), while a ten volt dimming signal results in maximum duty cycle (almost 50%) for the above inverter transistor with a maximum lamp load current (bright mode).

The safety control circuit is activated by means of a diode clamping current from a diode clamping circuit, the clamping current flowing whenever one or more lamps are removed from the lamp terminals. The diode clamping circuit includes two diodes and a sensing resistor, and is connected to a tap-point on the primary winding of the output transformer. Whenever one or more lamps are removed from the terminals of the lamp fixture, the output voltage of the ballast exceeds a predetermined value and the diodes in the diode clamping circuit conduct, resulting in a high frequency pulsed signal across the sensing resistor. This pulsed signal is converted to a DC signal by means of a capacitor and two small signal diodes which charge an electrolytic capacitor. A voltage divider network comprising two resistors connected to this electrolytic capacitor, is used to trigger a small signal NPN transistor whose emitter is tied to the inverter ground. A connection point is made from the collector of this NPN transistor to a point on the dimming control circuit. When this NPN transistor is triggered, it conducts and grounds its collector which is tied to one of the control points on the dimming control circuit. This forces the dimming control circuit to respond as if a zero volt dimming signal has been externally applied. The dimming control circuit therefore changes the duty cycle of one of the inverter transistors to go to its minimum value. This causes the output voltage made available to the removed lamp to drop by almost 20% which substantially reduces the magnitude of the through-lamp leakage current to safe levels. This mode of operation continues as long as at least one of the lamps is still removed from its lamp terminal. Once all of the removed lamps are replaced in the lamp terminals, the diodes in the diode clamping circuit stop conducting. The signal across the sensing resistor then disappears and there is no DC voltage available to trigger the NPN transistor, thereby deactivating the safety control circuit.

In another embodiment, the safety control circuit is used with a conventional series resonant ballast driving multiple lamps that does not have a dimming control circuit mentioned, but is still successful in reducing the magnitude of through-lamp leakage currents to safe levels. The DC power supply to the inverter in this case is also supplied by a boost power factor converter that is connected to the 60 Hz AC line. This boost power factor converter can be controlled by either an integrated circuit ("IC") or a circuit consisting of a few discrete components instead of an IC. The safety control circuit of the present invention can be applied to both the cases mentioned above. For example, it can be used in the series resonant ballast described in U.S. Pat. No. 5,650,925 ("the '925 patent") issued to MagneTek (shown in FIG. 9 of the '925 patent), where the boost power factor converter does not utilize an IC, but a pulse-width modulator (PWM) circuit which comprises a few discrete components. However, the alternative embodiment described in this current patent application will utilize a boost power factor converter circuit that is controlled by an IC. The main reason for this is to keep the explanation of the control aspects of the boost power factor converter as simple as possible while at the same time demonstrate clearly the effectiveness of the proposed safety control circuit. This boost-power factor converter uses an off the shelf power-factor correction integrated circuit ("PFC IC") to provide a steady DC bulk voltage, $V_{dc}$, to the inverter stage. Whenever at least one lamp is removed from its lamp terminal, the safety control circuit is activated and is used to control the PFC IC to lower $V_{dc}$. This lowers the magnitude of voltage in the tank circuit of the inverter, which reduces the voltage available to the lamp load and results in the lowering of the through-lamp leakage current.

In this embodiment, the collector of the NPN transistor in the safety control circuit is connected to the power supply pin of the PFC IC. For normal boost operation, the PFC IC supply pin has to be above an undervoltage threshold value. Therefore, when a lamp is removed and the NPN transistor in the safety control circuit conducts, the power supply pin of the PFC IC goes below its threshold value and is disabled. This lowers $V_{dc}$, resulting in an acceptable through-lamp leakage current. However, since $V_{dc}$ gets lowered significantly, the safety control circuit is deactivated because the output voltage of the ballast falls below its predetermined value and the diodes in the diode clamping circuit no longer conduct.

The power supply pin of the PFC IC then goes through its usual starting sequence, which it also goes through during initial power-up of the ballast. The PFC IC is disabled for about 1.2 seconds until the voltage at the PFC IC supply pin exceeds its undervoltage threshold value, and then it gets enabled and the DC bulk voltage jumps up to its regular designed value of $V_{dc}$. If the lamp is still removed, the diodes in the diode clamping circuit conduct, activating the safety control circuit which in turn immediately disables the PFC IC. Therefore, in such a condition, the power supply of the PFC IC alternately goes below and above its threshold value, resulting in a fluctuating DC bulk voltage. This causes flashing of the lamps to occur: bright when $V_{dc}$ is high and dim when $V_{dc}$ is low. However, because the time for which the lamps are fully on (bright) is very small (tens of microseconds), compared to the time for which they are dim (approximately 1.2 seconds), the net through-lamp leakage current is quite low and does not pose a shock hazard to a person attempting to remove and replace lamps from the lamp fixture driven by such a ballast. In this method, the flashing of the lamps is achieved by controlling the DC bulk voltage fed to the inverter and not by controlling the inverter transistors. This keeps the sensing and control circuit extremely simple and inexpensive, making it very easy to implement.

DESCRIPTION OF THE DIFFERENT EMBODIMENTS

Figure 1:
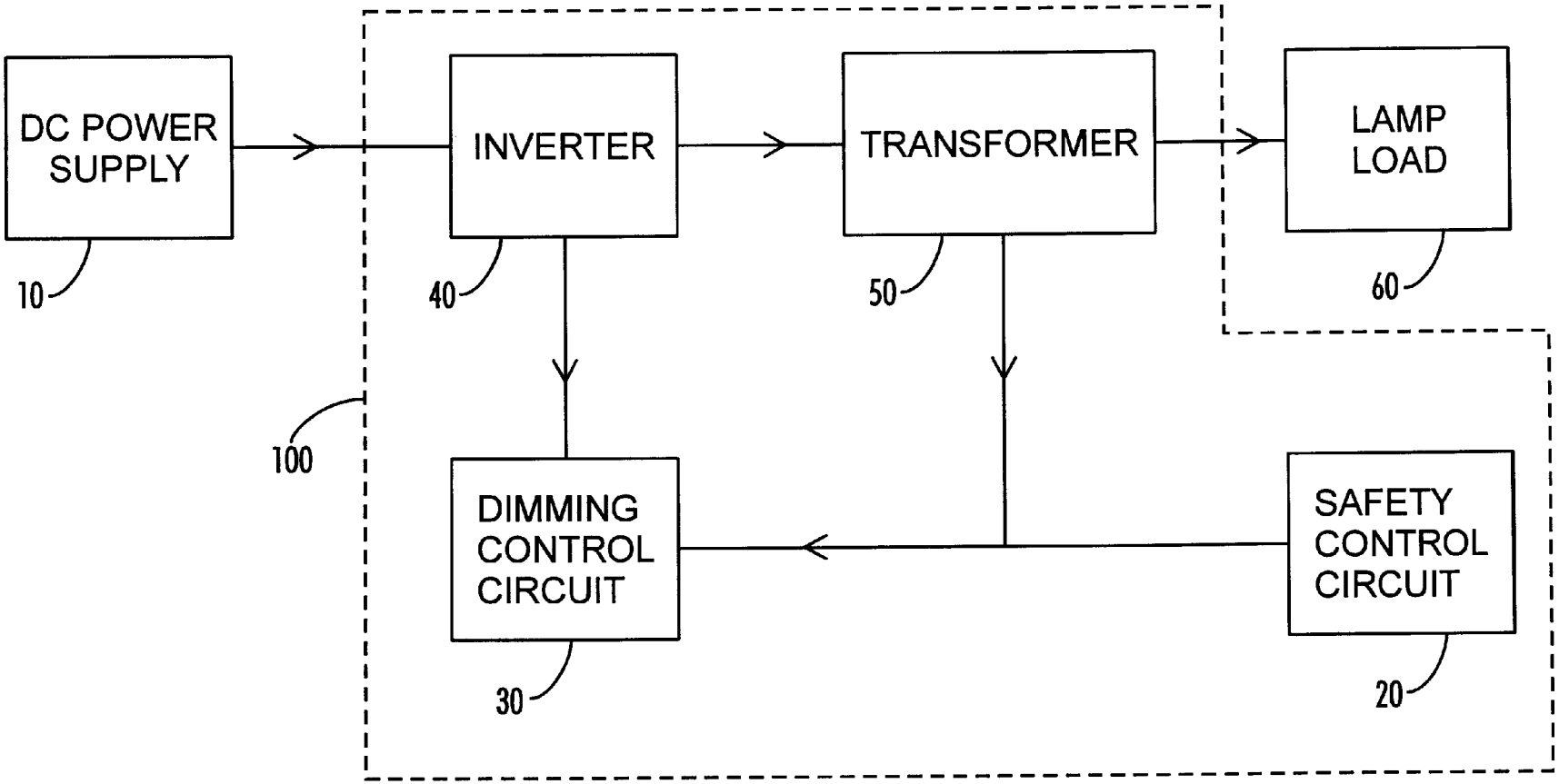
FIG. 1 is a block diagram of a series resonant ballast driving multiple lamps that uses a dimming control circuit for varying the lamp load currents and a safety control circuit to detect the removal of one or more lamps from the lamp load and to reduce the through-lamp leakage currents under such conditions.

FIG. 1 is a block diagram of the preferred embodiment of the series resonant ballast 100. It uses a dimming control circuit 30 to control the illumination of a fluorescent lamp load 60 (which is typically multiple lamps connected in series). The safety control circuit 20 of the present invention is used in conjunction with the dimming control circuit 30 for detecting the removal of one or more lamps from a lamp fixture (not shown) to reduce hazardous through-lamp leakage currents to acceptable levels. The DC power supply 10 (FIG. 1) supplies the DC power to a series resonant inverter 40. The resonant inverter 40 converts this DC power into AC at high frequency which is delivered to the fluorescent lamp load 60 through an output transformer 50. A current sense transformer 52 (shown in FIG. 2) is connected in series with the primary winding of the output transformer 50 and provides a feedback signal to the dimming control circuit 30 to regulate the amount of current flowing through the lamp load 60.

Figure 2:
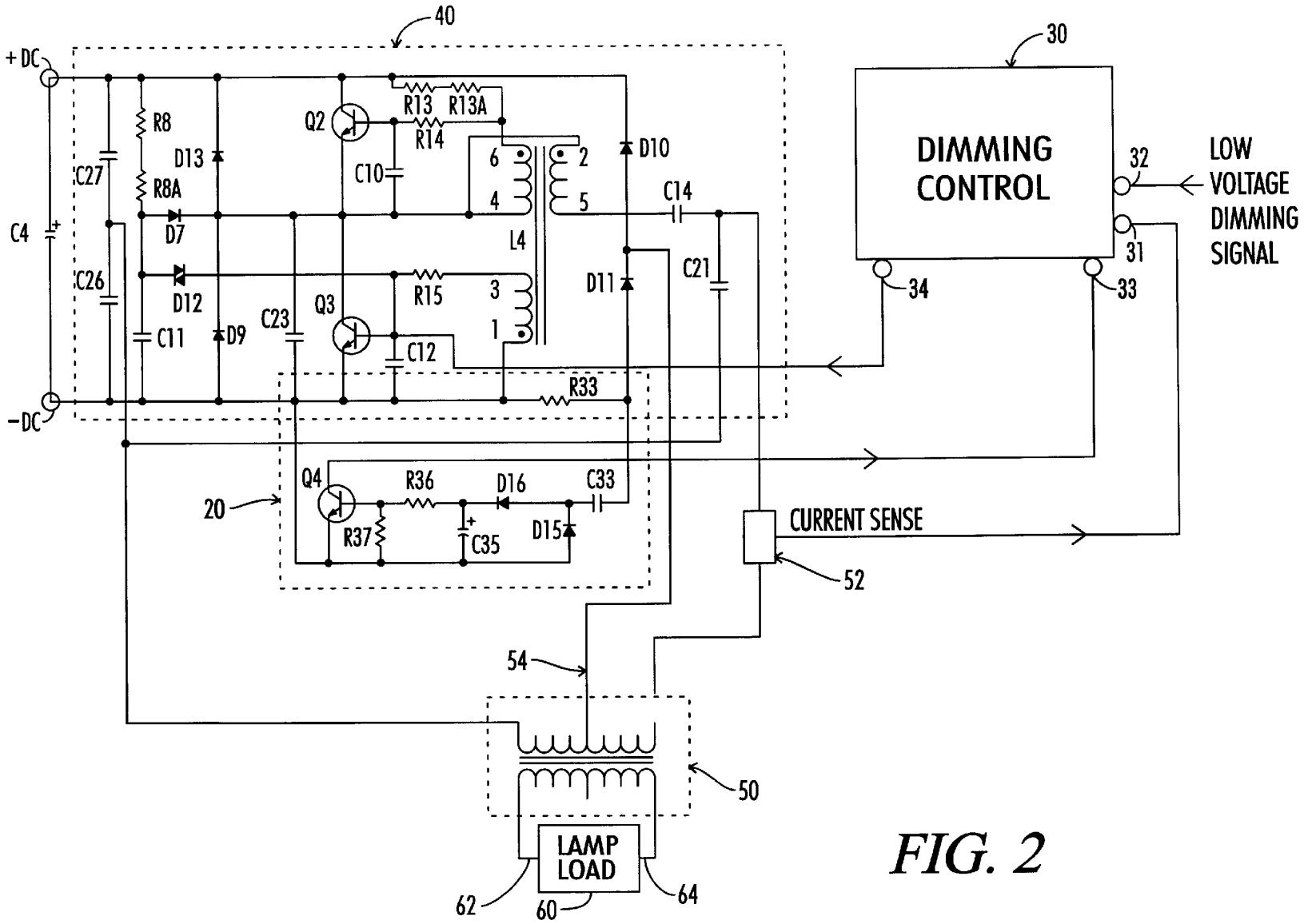
FIG. 2 is a schematic diagram of a portion of the circuitry used in the above series resonant ballast, including the safety control circuit of the present invention.

FIG. 2 is a detailed schematic of the circuits used in the series resonant ballast 100 shown in FIG. 1. The DC power supply 10 supplies a constant DC bulk voltage, $V_{dc}$, to the bulk capacitor C4. Capacitors C27 and C28 are film capacitors that are used to split the bulk voltage and provide a common connection point for the inverter 40. The inverter 40 is a series resonant half-bridge self-oscillating inverter with an inductor L4 and two capacitors C14 and C21 that form a tank circuit. Resistors R8 and R8A, capacitor C11, and diac D12 constitute the starting circuit to initiate inverter oscillations during initial power-up of the series resonant ballast 100. Transistors Q2 and Q3 are inverter transistors having their base drive circuits powered by auxiliary windings on the resonant choke inductor L4. The inverter 40 further includes diode D7 connected between resistor R8A and the emitter of transistor Q2. Diode D7 provides a discharge path for capacitor C11 after the inverter 40 starts. Diode D13 is connected between the collector and emitter of transistor Q2, and diode D9 is connected between the collector and the emitter of transistor Q3. Resistors R13 and R13A are connected in series between the collector of transistor Q2 and inductor L4. The base drive circuits for the inverter transistors Q2 and Q3 consist of resistors R14 and R15 and capacitors C10 and C12. Resistor R15 is connected between the base of transistor Q3 and one auxiliary winding of the resonant choke inductor L4. Resistor R14 is connected between the base of transistor Q2 and the second auxiliary winding of the resonant choke inductor L4. Capacitor C10 is connected between the base and the emitter of transistor Q2 and capacitor C12 is connected between the base and the emitter of transistor Q3.

The resonant inverter 40 converts the DC power into AC at high frequency (greater than 25 kHz) which is supplied to the lamp load 60 through an output transformer 50. The lamp load 60 can be a single lamp or can consist of multiple lamps in series. The output transformer 50 provides isolation and also steps up the voltage generated by the tank circuit of inverter 40 to a high voltage required to ignite the multiple lamps in series which constitute the lamp load 60. Diodes D10 and D11 are connected to a tap-point 54 on the primary winding of the output transformer 50 and constitute the diode clamping circuit. The tap point 54 is arranged so that diodes D10 and D11 conduct only when the output voltage of the ballast exceeds a predetermined value. Under such a condition, diodes D10 and D11 conduct and the output voltage gets clamped to the predetermined value, dictated by $V_{dc}$. A current sense transformer 52 is connected in series with the primary winding of the output transformer 50 and provides a feedback signal to the dimming control circuit 30 (at terminal 31) to regulate the amount of current flowing through the lamp load 60. A low voltage (0V-to-10V) dimming level signal (at terminal 32) serves as another input to the dimming control circuit 30. A third input to the dimming control circuit 30 (at terminal 33) comes from the collector of the NPN transistor Q4 used in the safety control circuit 20.

The dimming control circuit 30 operates to control the magnitude of current flowing through the lamp load 60. The dimming control circuit 30 achieves this by reducing the duty cycle of the transistor Q3 of the inverter 40 (through terminal 34) in response to a low-voltage dimming level signal (at terminal 32) indicative of the desired amount of current through the lamp load 60 (at terminal 31). This results in a change in the symmetry of the AC signal at the inverter 40 output which changes the level of current through the lamp load 60. Maximum current is delivered to the lamp load 60 when the above AC signal is symmetric—this corresponds to nearly 50% duty cycle of both transistors Q2 and Q3 in the inverter 40 (10V dimming level signal). This is called the "bright" operating mode. As the dimming level signal is varied from 10V to 0V, the duty cycle of transistor Q3 is reduced and the AC signal at the inverter 40 output becomes more asymmetric, which reduces the energy delivered by the resonant inverter 40 to the lamp load 60, thereby lowering the current delivered to the lamp load 60. Therefore, minimum current flows through the lamp load 60 when the duty cycle of transistor Q3 is at a minimum (usually around 15%). This corresponds to a zero volt dimming signal. This is called the "dim" operating mode. During the entire dimming range (10V to 0V or bright to dim mode), the safety control circuit 20 is inoperative and therefore does not interfere with the operation of the dimming control circuit 30.

As shown in FIG. 2, the safety control circuit 20 includes resistors R33, R36, and R37, capacitor C33, diodes D15 and D16, and transistor Q4. Resistor R33 is a small sensing resistor which is introduced in the diode clamping circuit of the resonant inverter 40 to sense when a lamp has been removed. The cathode of diode D10 is connected to the positive terminal of capacitor C4 while the anode of diode D10 is connected to the cathode of diode D11 which is also connected to a tap-point 54 on the primary winding of the output transformer 50. Resistor R33 is connected between the anode of diode D11 and inverter 40 ground.

The safety control circuit 20 operates in the following manner. Under normal operating conditions, the DC bulk voltage across capacitor C4 is almost constant. Whenever one or more lamps of lamp load 60 are removed from their lamp terminals 62 and 64, the output voltage of the ballast 100 exceeds its predetermined value and diodes D10 and D11 conduct (irrespective of the external dimming level signal), resulting in a high frequency pulsed voltage signal across resistor R33. This is converted to a DC signal by means of capacitor C33 and two small signal diodes D15 and D16 which charge up an electrolytic capacitor C35. The DC voltage across capacitor C35 goes through a voltage divider network consisting of resistors R36 and R37 to trigger a small signal NPN transistor Q4. The emitter of transistor Q4 is tied to the ground of the inverter 40 while its collector is connected to a point on the dimming control circuit 30. When transistor Q4 is triggered, it conducts and grounds its collector, which in turn grounds one of the control points on the dimming control circuit 30. This forces the dimming control circuit 30 to behave as if a zero volt external dimming signal has been applied. Therefore, the dimming control circuit 30 changes the duty cycle of transistor Q3 to its minimum value. This reduces the output voltage available to the lamp load 60, which results in a low through-lamp leakage current which is well within the safe levels specified by Underwriters Laboratories, Inc. ("UL"). This condition persists as long as at least one lamp in the lamp load 60 is removed from either lamp terminal 62 or 64. Once all of the lamps in the lamp load 60 are placed back in the lamp terminals 62 and 64, the voltage across the lamp load 60 reduces, diodes D10 and D11 no longer conduct, and the voltage signal across the sensing resistor R33 disappears. Therefore, no voltage signal is available across capacitor C35, and hence no DC voltage to trigger transistor Q4. The safety control circuit 20 then gets deactivated. Thus, whenever one or more lamps from lamp load 60 are removed from their lamp terminals 62 and 64, the safety control circuit 20 sends out a signal to the dimming control circuit 30 (at terminal 33) which overrides any external dimming level signal received by the dimming control circuit 30 (at terminal 32). This forces the dimming control circuit 30 to reduce the duty cycle of the transistor Q3 of the resonant inverter 40 to a minimum, which in turn reduces the through-lamp leakage current to a minimum thereby preventing shock hazards.

Figure 3:
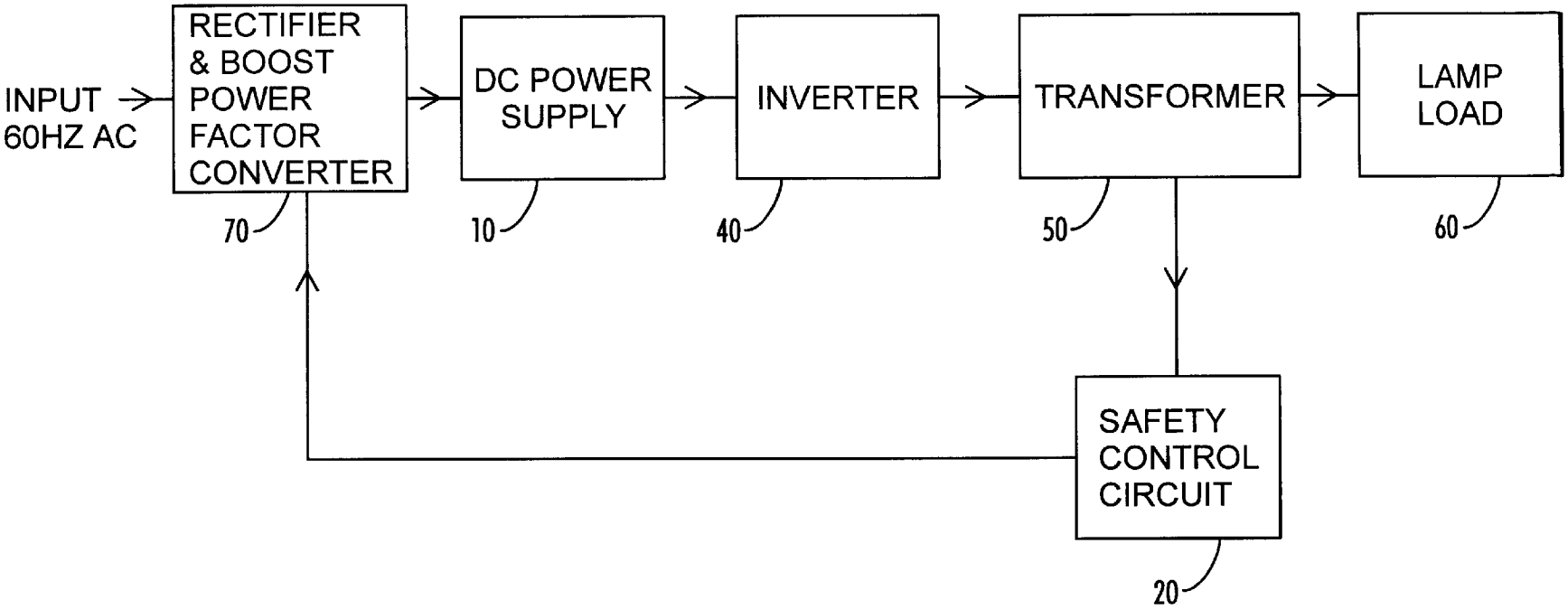
FIG. 3 is a block diagram of a series resonant ballast driving multiple lamps having a power factor correction integrated circuit which is controlled by the safety control circuit of the present invention to reduce the magnitude of the through-lamp leakage currents to acceptable levels in the case of removal of one or more lamps from the lamp load.

FIG. 3 is a block diagram of an alternative embodiment where the safety control circuit 20 of the present invention is applied to a standard series resonant ballast 100 driving multiple lamps. The design of FIG. 3 is similar to that of FIG. 2 except that FIG. 3 does not provide for the dimming control circuit 30. The DC power is supplied to the resonant inverter 40 through a boost power factor converter and rectifier circuit 70, which is connected to the 60 Hz AC line. The safety control circuit 20 provides a signal to the boost power factor converter and rectifier circuit 70 to reduce the through-lamp leakage currents whenever one or more lamps are removed from the lamp load 60.

Figure 4:
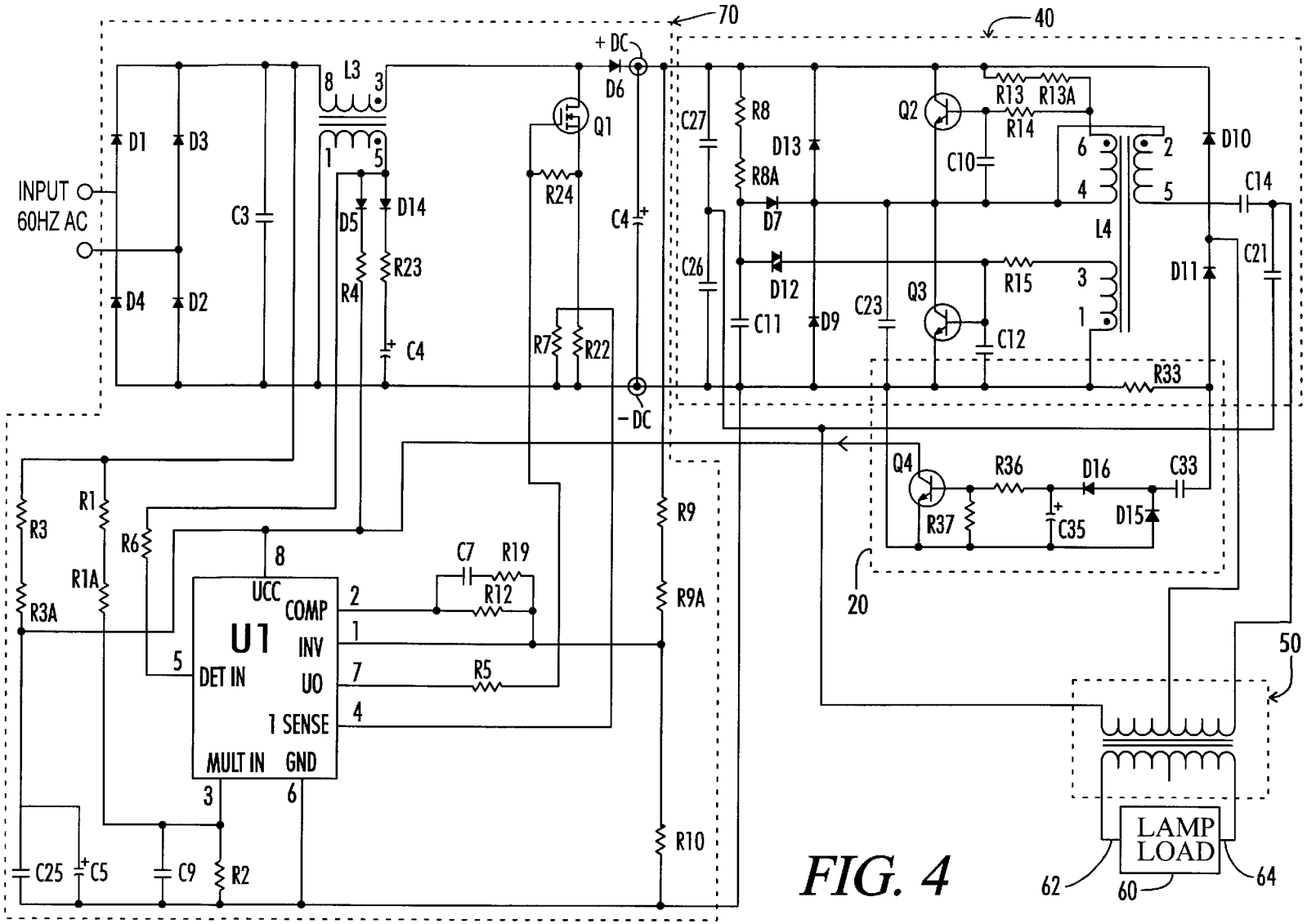
FIG. 4 is a schematic diagram of a portion of the circuitry used in the alternative embodiment that includes the safety control circuit of the present invention.

FIG. 4 is a detailed schematic of the circuits which constitute the block diagram shown in FIG. 3. The DC power supply (+DC to −DC) to the resonant inverter 40 comes from a boost power factor converter and rectifier circuit 70, which is connected to the 60 Hz AC line. Diodes D1 through D4 form the rectifier bridge, while inductor L3, transistor Q1 (typically a MOSFET (metal oxide semiconductor field effect transistor)), diode D6 and capacitor C4 along with integrated circuit U1 and associated circuitry form the boost power factor converter. Inductor L3 is the boost inductor, transistor Q1 is the boost switch, diode D6 is the boost diode and capacitor C4 is the bulk capacitor. Integrated circuit U1 is the boost PFC IC which controls the boost power factor converter to achieve power factor correction at the input of the AC line.

The safety control circuit 20 and the boost power factor converter and rectifier circuit 70 work to keep the through-lamp leakage currents within set limits, even in the absence of a dimming control circuit 30. During the initial powering of the ballast shown in FIG. 4, the AC input line is rectified by diodes D1 through D4 and the power supply capacitor C5 of integrated circuit U1 starts charging through resistors R3 and R3A. Resistors R3 and R3A and capacitor C5 are so chosen that it takes about 1.2 seconds for the voltage across capacitor C5 to exceed the undervoltage lockout (UVL) of the power supply pin 8 of integrated circuit U1. So, for this time interval, integrated circuit U1 is disabled which means that the boost power factor converter is disabled. Therefore, the bulk capacitor C4 only gets charged to the peak voltage of the input AC line voltage which is much less than the normal operating DC bulk voltage $V_{dc}$ (when the boost power factor converter is enabled). During this time, capacitor C11 in the inverter 40 gets charged through resistors R8 and R8A, exceeds the breakover voltage of diac D12, and initiates inverter oscillations by triggering transistor Q3. The inverter 40 then starts operating, and since $V_{dc}$ is lower than normal, the magnitude of voltage available at the output of the inverter 40 is low, which results in a lower voltage available to the lamp load 60. This voltage is not high enough to strike an arc in the lamp load 60 and results in a very low magnitude of current through the lamp load 60. This condition exists for about 1.2 seconds until the boost power factor converter is enabled.

Once this happens, $V_{dc}$ increases to its normal value, which is sufficient to strike an arc in the lamp load 60, enabling lamp starting. Thus, it takes about 1.2 seconds from the time that the ballast 100 receives power through the input AC line to the time that lamps start in the lamp load 60. This time of 1.2 seconds is used to heat the lamp filaments in the lamp load 60 to the proper temperature by applying a small voltage to them. Whenever one or more lamps in the lamp load 60 are removed from at least one of the lamp terminals 62 or 64, transistor Q4 of the safety control circuit 20 gets triggered as explained in the previous sections. When transistor Q4 conducts, it grounds the power supply pin 8 of integrated circuit U1; C5 gets discharged and its voltage goes below the UVL threshold of integrated circuit U1 and hence disables it. Therefore, the boost power factor converter is disabled and hence the value of $V_{dc}$ is lowered. This results in a smaller voltage at the output of the inverter 40 and therefore a smaller voltage available to the lamp load 60 which is not sufficient to sustain the arc in the lamp load 60. The magnitude of the current through the lamp load 60 therefore drops appreciably resulting in an acceptable through-lamp leakage current. However, since the to voltage at the output of the inverter 40 has dropped considerably, the clamping diodes D10 and D11 no longer conduct and deactivate the safety control circuit 20. Consequently, transistor Q4 stops conducting and the power supply pin 8 of integrated circuit U1 goes through its usual starting sequence. Capacitor C5 starts charging through resistors R3 and R3A and it takes about 1.2 seconds for the UVL of integrated circuit U1 to be exceeded to enable the boost converter, increase the DC bulk voltage to its normal value $V_{dc}$ and for the lamps in the lamp load 60 to again strike (if all the removed lamps have been replaced). Even if one of the lamps in the lamp load 60 is still removed from its lamp terminal, transistor Q4 will again be triggered, disabling the boost power factor converter and causing $V_{dc}$ to fall, resulting in a smaller voltage available to the lamp load 60 which is not sufficient to sustain the lamp arc. The magnitude of current through the lamp load 60 will thereby be lowered and the above cycle will repeat until all the lamps in the lamp load 60 have been replaced. Thus, when a lamp is removed, the power supply pin 8 of integrated circuit U1 alternately goes below and above its UVL threshold value, resulting in a fluctuating DC bulk voltage across capacitor C4. This causes flashing of the lamps in the lamp load 60; the lamps are fully lit when $V_{dc}$ is high and the lamps are very dimly lit when $V_{dc}$ is low. However, since the time for which the lamps are fully lit is very small (tens of microseconds) compared to the time for which they are dimly lit (about 1.2 seconds), the net through-lamp leakage current is very low and easily passes the limits set by UL. Therefore, such a series resonant ballast 100 with the safety control circuit 20 does not pose a shock hazard to a person attempting to remove or replace lamps connected to the lamp load fixture.

Even though lamp flashing techniques have been discussed in literature to prevent shock hazards, the above method is novel since it achieves the desired results by directly controlling the DC bulk voltage fed to the inverter 40, rather than controlling the inverter transistors Q2 and Q3. The described method is therefore simpler to implement and is more cost effective.

The present invention has been described in connection with the preferred embodiments thereof, and it will be understood that many modifications and variations will be readily apparent to those of ordinary skill in the art without departing from the spirit or scope of the invention and that the invention is not to be taken as limited to all the details herein. Therefore, it is manifestly intended that this invention be limited only by the claims and equivalents thereof.

What is claimed is:

1. A ballast circuit for controlling one or more fluorescent lamps connected to a pair of lamp terminals of a lamp fixture comprising:

a DC power supply;

an inverter connected to the DC power supply and to the lamp fixture;

a safety control means for reducing a through-lamp leakage current to eliminate a shock hazard when a lamp is removed from the lamp terminals;

wherein the safety control means is activated by an electrical signal produced by a clamping current flowing through a clamping circuit when the lamp is removed; and wherein the inverter continues to operate while the safety control means is activated.

2. The ballast circuit of claim 1, wherein the safety control means further comprises a transistor connected to the clamping circuit, the transistor being activated by the clamping current to reduce the output voltage available to the fluorescent lamps.

3. A ballast circuit for controlling one or more fluorescent lamps connected to a pair of lamp terminals of a lamp fixture comprising:

a DC power supply, an inverter, and a transformer, the inverter being electrically connected between the DC power supply and the transformer, the DC power supply operative to provide a DC voltage to the inverter, the inverter operative to provide an AC voltage to the transformer, the transformer being electrically connected to the lamp terminals;

a dimming control circuit electrically connected to the inverter, the dimming control circuit operable to cause the output of the inverter to vary between a low level and one or more high levels; and a safety control circuit electrically connected to the dimming control circuit and to the transformer, the safety control circuit operable to sense an increase in voltage at the transformer when a lamp is removed from the lamp fixture and to cause the dimming control circuit to force the inverter output to change to a low level.

4. The ballast circuit of claim 3 further comprising at least one clamp diode in the circuit connected to the transformer and the safety control circuit, whereby the safety control circuit senses an increase in voltage by an increase in current through the clamping diode when a lamp is removed from the lamp fixture.

5. The ballast circuit of claim 4, the safety control circuit further comprising at least one transistor that controls the dimming control circuit when it is conducting.

6. The ballast circuit of claim 3, wherein the safety control circuit further comprises:

a sensing resistor providing a pulsed voltage when a lamp has been removed from the lamp terminals;

a rectifying means for converting the pulsed voltage across the sensing resistor into a DC voltage; and a transistor electrically connected to the dimming control circuit.

7. The ballast circuit of claim 3, wherein the rectifying means comprises a pair of diodes and a capacitor.

8. A method for controlling one or more fluorescent lamps connected to lamp terminals of a lamp fixture, the method comprising:

a. supplying a DC voltage through a DC power supply to an inverter electrically connected to a transformer;

b. converting the DC voltage to an AC voltage via the inverter for use by the fluorescent lamps connected to the transformer;

c. sensing an increase in voltage at the transformer when a lamp is removed from the lamp terminals through a safety control circuit that is electrically connected to the transformer; and d. reducing the voltage output from the inverter in response to the increase in voltage sensed by the safety control circuit.

9. The method of claim 8 further comprising varying the level of output from the inverter between a low output level and one or more high output levels through a dimming control circuit electrically connected to the inverter.

10. The method of claim 9 further comprising:

a. sending a signal from the safety control circuit to the dimming control circuit;

b. forcing the dimming control circuit to decrease the duty cycle of a transistor in the inverter; and c. producing a low value signal corresponding to the input.

11. A ballast circuit for controlling one or more fluorescent lamps electrically connected to lamp terminals of a lamp fixture comprising:

a rectifier for receiving an AC power;

a boost power factor converter for converting the AC power into a DC power;

an inverter for receiving the DC power from the boost power factor converter and providing an AC current to the lamp terminals through a transformer, the output of the inverter variable from a low to high level; and a safety control circuit electrically connected to the transformer and to the power factor converter, the safety control circuit operable to sense an increase in output voltage at the transformer when a lamp is removed from the lamp fixture and cause a change in the power factor converter thereby forcing the inverter to produce a low level output.

12. The ballast circuit of claim 11 further comprising at least one clamp diode in the circuit connected to the lamp terminal, whereby the safety control circuit senses an increase in voltage by an increase in current through the clamping diode when a lamp is removed from the lamp fixture.

13. The ballast circuit of claim 11, the safety control circuit further comprising at least one transistor that controls the power factor converter when it is conducting.

14. The ballast circuit of claim 11, wherein the safety control circuit further comprises:

a sensing resistor providing a pulsed voltage when a lamp has been removed from the lamp terminals;

a rectifying means for converting the pulsed voltage across the sensing resistor into a DC voltage; and a transistor electrically connected to the power factor converter.

15. A method for controlling one or more fluorescent lamps connected to lamp terminals of a lamp fixture, the method comprising:

a. supplying an AC voltage to a rectifier and a power factor converter;

b. supplying a DC voltage from the rectifier and power factor converter to an inverter electrically connected to the lamp terminals;

c. converting the DC voltage to an AC voltage by the inverter for use by the fluorescent lamps connected to the lamp terminal;

d. generating a diode clamp current through a diode clamp circuit in response to an increase in output voltage at the lamp terminals when a lamp is removed from the lamp fixture;

e. directing the diode clamp current to a safety control circuit that is electrically connected to the power factor converter and the lamp terminals;

f. disabling the power factor converter through the safety control circuit in response to the diode clamp current; and g. reducing the DC voltage provided to the inverter from the power factor converter while the power factor converter is disabled.

* * * * *